US006865982B2

(12) United States Patent
Bunyard et al.

(10) Patent No.: US 6,865,982 B2
(45) Date of Patent: Mar. 15, 2005

(54) VALVE ACTUATOR

(75) Inventors: Adam Bunyard, Brighton (GB); Alan Bunyard, Brighton (GB)

(73) Assignee: Forac Limited (GB)

( * ) Notice: Subject to any disclaimer, the term of this patent is extended or adjusted under 35 U.S.C. 154(b) by 58 days.

(21) Appl. No.: 10/347,329

(22) Filed: Jan. 21, 2003

(65) Prior Publication Data

US 2003/0136258 A1 Jul. 24, 2003

(30) Foreign Application Priority Data

Jan. 18, 2002 (GB) ..... 0201159

(51) Int. Cl.[7] ..... F01C 9/00
(52) U.S. Cl. ..... 92/120; 92/130 C

(58) Field of Search ..... 92/120, 130 C, 92/130 R

(56) References Cited

U.S. PATENT DOCUMENTS

| | | | | | |
|---|---|---|---|---|---|
| 2,936,636 | A | * | 5/1960 | Wacht | 92/120 |
| 2,996,049 | A | * | 8/1961 | Huska | 92/120 |
| 3,070,075 | A | * | 12/1962 | Hanselmann | 92/120 |
| 5,007,330 | A | * | 4/1991 | Scobie et al. | 92/120 |
| 6,269,888 | B1 | * | 8/2001 | Schuda et al. | 173/48 |

* cited by examiner

*Primary Examiner*—Edward K. Look
*Assistant Examiner*—Michael Leslie
(74) *Attorney, Agent, or Firm*—Diller, Ramik & Wight

(57) ABSTRACT

A fluid operated actuator comprising a cylinder, a piston and a linkage rod connected to the piston, in which the cylinder is curved through a number of degrees.

22 Claims, 2 Drawing Sheets

VALVE ACTUATOR

BACKGROUND OF THE INVENTION

This invention relates to a fluid operated actuator device utilising a primary rotational movement.

In conventional fluid operated actuators, for example 90 degree valve actuators, the primary movement is the linear motion of a piston and cylinder, which has to be transferred into a secondary rotational movement to actuate the valve. Such arrangements require a surplus of moving parts, so they can be complex in structure and hence difficult to service and use.

In known 90 degree valve actuators the linear movement of a piston inside a cylinder is transferred into a rotational movement by a linkage rod attached at its inner end to the piston, and attached via an actuator linkage at its outer end to a turning arm mounted on a rotatable shaft. The rotating movement of the actuator linkage provides uneven torque to the shaft, which operates the valve. When the piston is at the bottom of the cylinder and the valve is in the fully shut or fully open position the actuator linkage is wider than 90 degrees. As the piston moves up the cylinder the linkage closes, and is at 90 degrees when the piston is approximately half way up the cylinder. The linkage continues to close until the piston is at the top of the cylinder and the linkage reaches its narrowest angle, which is less than 90 degrees. The torque applied to the linkage is at its greatest when it is at 90 degrees and the full force of the piston is applied straight down the linkage rod to turn the valve shaft. The torque decreases when the linkage is wider or narrower than 90 degrees, at the beginning and at the end of the stroke.

This variation in torque causes a particular problem for valve actuators, because the valves are known to stick shut during operation. So-called "break out torque" is required to re-open the valve and resume operation. Break out torque is greater than the torque required to actuate the valve normally, and is the highest torque required of the valve actuator at any time. Therefore, a valve actuator powered by the linear movement of a fluid operated (hydraulic or pneumatic) piston and cylinder as described above must be able to provide the required break out torque at the beginning or the end of the stroke, when the torque provided is at its lowest. This means that a piston and cylinder arrangement is required which provides an excess of power in the middle of its stroke.

Valve actuators are used in industries which require a high level of sanitation, for example at chemical or food processing plants. As a result pneumatic cylinders are preferred to hydraulic arrangements because of the reduced risk of contamination. Further, it is desired to have a valve actuator constructed wholly from stainless steel because this is more readily sanitised than other materials, for example aluminium.

Many known types of valve actuators use spring loaded piston and cylinder arrangements which can be hazardous to assemble for use and disassemble for cleaning and maintenance.

SUMMARY OF THE INVENTION

It is the object of the present invention to provide a new approach to overcome some of these problems.

According to the present invention a fluid operated actuator comprises a cylinder, a piston and a linkage rod connected to the piston, in which the cylinder is curved through a number of degrees.

Preferably the cylinder is curved through substantially 90 degrees, and the linkage rod is also curved through substantially 90 degrees. The linkage rod can be connected at its outer end to a turning arm mounted on a rotatable shaft.

The turning arm can be mounted under compression in order to return the piston to the bottom of the cylinder at the end of each stroke and rotate the shaft back to its starting position.

The cylinder, the turning arm and the compression means are preferably mounted on a base plate to prevent any undesired lateral or expansional movement during the operation of the actuator. The compression means is preferably a flat spiral spring, mounted at its outer end to the base plate and at its inner end to the shaft, or the connection between the turning arm and the shaft.

The actuator can be a 90 degree valve actuator, and the rotatable shaft can actuate the valve.

In a preferred construction the cylinder is a pneumatic cylinder, powered by pressurized air or dry air, which is introduced to the bottom of the cylinder through an aperture. The piston can be an air-tight seal which moves up the cylinder when the air is introduced, and is returned to the bottom by the spring when the air pressure is reduced. In one construction lower and upper end elements are provided at each end of the cylinder. The upper end element can have an aperture through which the linkage rod can pass.

Preferably the base plate is a circular disk, with the cylinder mounted adjacent to the edge and with the shaft passing through the centre. With this arrangement an open space is provided on one half of the disc, upon which switches, control means and measuring apparatus can be mounted.

A cover can be fitted over the top of the valve actuator and fitted to the edge of the base plate. In one construction the cover can be constructed from a transparent material to allow ready inspection of the actuator.

Preferably the component parts of the actuator including the cylinder, the piston, the linkage rod, the turning arm, the shaft, the spring, the base plate, the lower end element, upper end element, and the cover are all constructed from stainless steel. Further the cylinder is preferably constructed from a straight piece of stainless steel tubing which is bent through substantially 90 degrees to form its shape. The stainless steel tubing is preferably provided with a finish of 25 micro inches or finer. In one construction the shaft can be provided with two turning arm fixing points disposed at substantially 90 degrees to one another, and with locking means to secure it in position on the base plate. With this arrangement a spring can be fitted to and removed from the actuator in safety, as set forth in the method below.

The invention also includes a method of placing under compression a turning arm of a 90 degree valve actuator comprising a cylinder, a piston, a linkage rod, a turning arm, a rotatable shaft, a base plate and a coil spring, in which the linkage rod is connected at its inner end to the piston and at its outer end to the outer end of the turning arm, and the turning arm is releasably connected at its inner end to the shaft, and in which the shaft passes through the base pate and is provided with a spring mounting means, two turning arm mounting points disposed at substantially 90 degrees to one another, and shaft locking means to hold the shaft in one position in relation to the base plate, and in which the cylinder is mounted on the base plate, and in which the base plate is provided with spring mounting means, and in which the cylinder and the linkage rod are curved through substantially 90 degrees, which comprises the steps of:

1. Mounting the outer end of the coil spring to the spring mounting means on base plate and the inner end to spring mounting means on the rotatable shaft, with the spring under zero compression.
2. Mounting the turning arm to the first mounting point provided on the shaft.
3. Applying fluid pressure to the cylinder and rotating the shaft through 90 degrees, putting the spring under compression.
4. Securing the shaft to the base plate with the shaft securing means.
5. Releasing the fluid pressure inside the cylinder.
6. Disconnecting the turning arm from the shaft.
7. Pushing the turning arm, the linkage rod and the piston back through 90 degrees.
8. Reconnecting the turning arm to the second mounting point provided on the shaft, which is at substantially 90 degrees to the first.
9. Release the shaft from the disc.

To disassemble the device the method is carried out in reverse.

BRIEF DESCRIPTION OF THE DRAWINGS

The invention can be performed in various ways, but two examples will now be described with reference to the accompanying drawings, in which.

DESCRIPTION OF THE PREFERRED EMBODIMENTS

Figure 1:
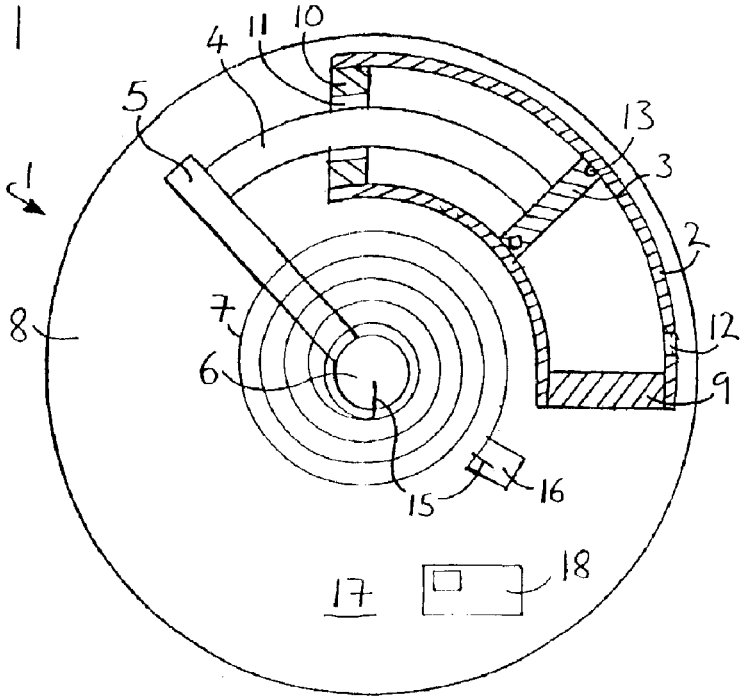
FIG. 1 is a diagrammatic top view of an actuator according to the present invention with the cylinder and piston shown in cross-section.
Figure 2:
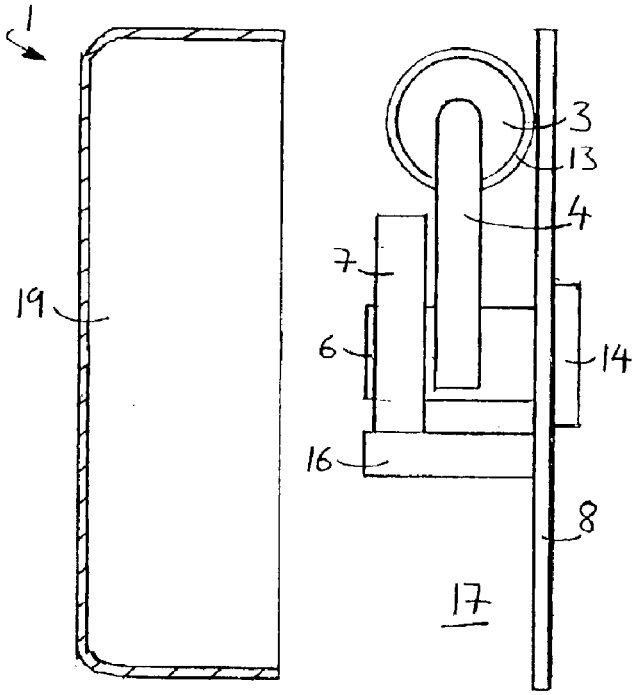
FIG. 2 is a side view of the actuator as shown in FIG. 1 with the cylinder not shown; and, FIG. 3 is perspective view of a second actuator according to the present invention.

In FIGS. 1 and 2 a 90 degree valve actuator 1 comprises a cylinder 2 (not shown in FIG. 2), a piston 3, a linkage rod 4, a turning arm 5, a rotatable shaft 6, a flat spiral spring 7 and a base plate 8.

The cylinder 2 is secured to the base plate 8 with fixings (not shown) and is provided with a lower end element 9 and an upper end element 10 (not shown in FIG. 2), provided with an aperture 11 through which the linkage rod 4 can pass. The aperture 11 is dimensioned to allow free movement of the linkage rod 4 at every point of the stroke. The cylinder 2 is also provided with a pressure aperture 12 through which pressurized air can be introduced to the cylinder.

The piston 3 is provided with an O-ring seal 13, and can move freely up and down the length of the cylinder 2. The linkage rod 4 is secured to the piston 3 and the turning arm 5 in a non-hinged arrangement. The turning arm 5 is secured to the shaft 6 in a non-hinged arrangement.

Shaft 6 passes through an opening (not shown) in the centre of the base plate 8, and is provided with a universal fixing section 14 on the underside of the base plate 8 for fixing to known types of valves.

Flat spiral spring 7 is provided with end abutments 15 which fit into slots provided in base plate fixing boss 16, and in the shaft 6. The base plate 8 is circular in shape, and hence is provided with open area 17, onto which switches and controls 18 can be fixed. As shown in FIG. 2 the actuator 1 is also provided with a cover 19 (shown removed and in cross-section) which fits onto the base plate 8.

The major component parts including the cylinder 2, the piston 3, the linkage rod 4, the turning arm 5, the shaft 6, the spring 7, the base plate 8, lower end element 9, upper end element 10 and the cover 19 are all constructed from stainless steel. (The cover 19 can also be constructed from a suitable transparent material to allow ready inspection of the actuator). The cylinder 2 is constructed from a straight piece of stainless steel tube which is bent through 90 degrees to form its shape. With this arrangement there is no need to machine a curved stainless steel tube with the necessary smooth surface, which would be very difficult. To function correctly a seal needs to run inside a tube with a 25 micro-inch or finer finish, which can be readily provided in straight stainless steel tubes.

As shown in FIG. 1 the piston 3 is half way through a stroke. Pressurized air has been introduced to the cylinder 2 through pressure aperture 12 forcing the piston 3 up the cylinder. As a result linkage rod 4 turns turning arm 5 which rotates shaft 6 and operates the valve (not shown). Flat spiral spring 7 is mounted in compression on the base plate fixing boss 16 and the shaft 6, and is acting against the movement of the piston 3. When the piston 3 reaches the end of the stroke and is adjacent the upper end element 10 the air pressure will be reduced to a pressure lower than the force of the spring 7, and the spring 7 will push the piston 3 back down the cylinder 2 to the beginning point of the stroke adjacent the lower end element 9. The pressurized air is introduced to the cylinder to produce strokes at whatever rate is required to control the flow of the fluid passing through the valve.

During development of actuator 1 it was found that various undesired forces could act on the working parts of the actuator. If the working parts are not secured in a particular fixed relationship during the stroke the spring 7 can apply an outward radial force on the linkage rod 4 which acts to straighten it. In addition the piston 3 is placed under a rotational force inside the cylinder 2 by the spring 7. Further it was found that a force can act on the end of the linkage rod 4 where it is connected to the turning arm 5, which drives the two parts into the surface of the base plate 8. However, these forces are controlled in actuator 1, because the cylinder 2 and the turning arm 5 are secured in the same plane on the base plate 8, and the shaft 6 is positioned in the centre of the turning circle of the piston 3.

It will be appreciated that the invention can be applied to an actuator device which turns through more or less than 90 degrees, if the need arises.

Figure 3:
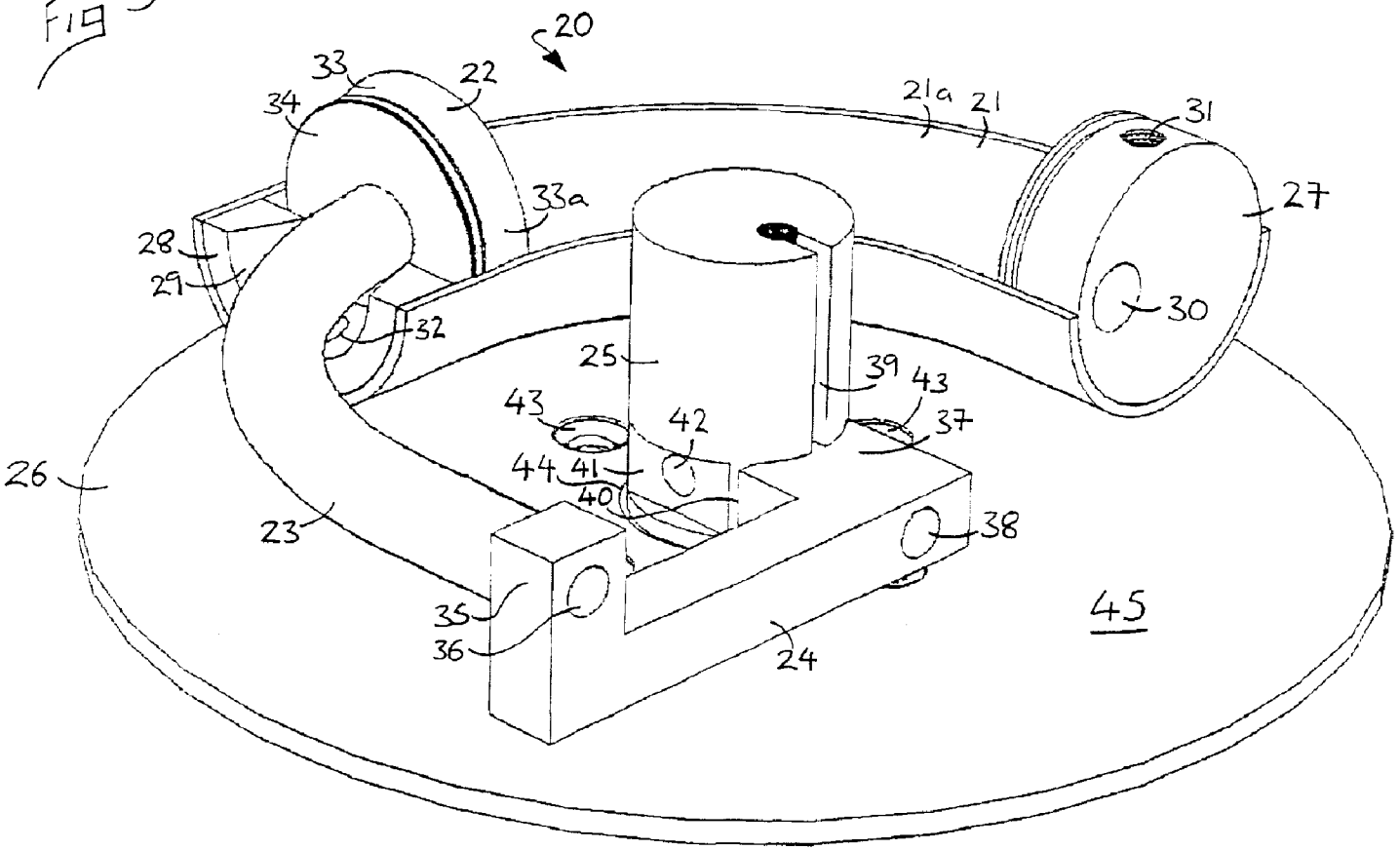

In FIG. 3 90 degree valve actuator 20 comprises a cylinder 21, a seal 22, a linkage rod 23, a turning arm 24, a rotatable shaft 25 and a base plate 26. (Actuator 20 functions with a flat spiral spring, but for convenience this is not shown.)

Cylinder 21 is provided with a lower end element 27 and an upper end element 28, which is provided with an aperture 29. Aperture 29 is tapered to allow the linkage rod 23 to pass freely through at every point of the stroke. Lower end element 27 is provided with aperture 30 through which dry air can be introduced to the cylinder 21. Lower end element 27 is secured in place inside the cylinder 21 be means of a screw (not shown) which passes through an opening in the top of the cylinder (not shown) into screw hole 31. Cylinder 21 is secured to the base plate 26 by screws (not shown) which pass through openings in its lower surface (not shown) adjacent to the upper and lower end elements 27, 28. Opening 32 is provided in upper end element 28 which co-operates with an opening in the cylinder 21 and in the base plate 26.

Seal 22 has a rubberised cup shaped body 33, and a top plate 34, which is connected to the linkage rod 23. The turning arm 24 is provided with a vertical abutment 35 at its outer end which is provided with a screw hole 36 for fixing to the linkage rod 23. Turning arm 24 is also provided with a lateral abutment 37 at its inner end and a screw hole 38 for fixing to the shaft 25.

Shaft 25 is provided with spring mounting slot 39 for co-operation with a flat spiral spring (not shown), and two turning arm fixing points 40, 41 disposed at 90 degrees to one another. Both fixing points 40, 41 are provided with screw holes 42 for fixing to the turning arm 24.

Base plate 26 is provided with fixture holes 43 to fixing to a known valve device (not shown), and a central opening 44 through which shaft 25 passes. Base plate 26 is also provided with open area 45 onto which switches and control means (not shown) can be fixed.

The major components of actuator 20 are constructed from stainless steel, including the cylinder 21, the linkage rod 23, the turning arm 24, the shaft 25, the base plate 26, the lower end element 27 and the upper end element 28. As with actuator 1 as shown in FIGS. 1 and 2 the cylinder 21 is constructed from a straight piece of stainless steel tube which is bent through 90 degrees.

During development of actuator 20 it was found that an undesired rotational force can act on the seal 22 if the valve (not shown) sticks and the shaft 25 does not rotate. The dry air pressure pushing against the static seal 22 can force it to rotate in an anti-clockwise direction and against the outer side 21*a* of the cylinder 21. As a result leaks can occur. However, this problem has been overcome in actuator 20 because of the materials used to construct the seal 22. The body 33 is constructed from a resilient P.T.F.E. compound which is suitable for use with dry air, and the top plate 34 is constructed from a suitable plastics material, for example DeIrin acetal resin, which is less resilient than the body 33, but which is more resilient than the cylinder 21. When a rotational force acts on the seal 22 the cup shaped body 33 is compressed against the outer side 21*a* of the cylinder, however no leaks occur because when the top plate 34 comes into contact with the cylinder wall it provides sufficient support to prevent the inward facing portion of the body 33*a* coming away from the cylinder surface and being breached. When the valve unsticks and the shaft 25 begins to rotate again the top plate 34 runs against the inside surface of the cylinder 21 for a period, however, because it is more resilient than the cylinder 21 no damage is caused to the inside surface. (It will be appreciated that the above described undesired rotational force can be overcome by constructing a stiffer linkage rod, however this adds to weight and cost.)

In normal use the actuator 20 operates in substantially the same manner during the stroke as the actuator 1 shown in FIGS. 1 and 2, except that dry air is used and is introduced to the cylinder 21 via aperture 30 in lower end element 27, and piston 3 and bring seal 13 have been replaced with seal 22. However, actuator 20 features means to place a flat spiral spring (not shown) under compression for operation of the actuator. In order to mount a spring under compression the following steps are taken:

1. The inner end of a flat spiral spring is mounted in the mounting slot 39 on the shaft 25 and the outer end is mounted on a base plate mounting boss (not shown). The spring is under no compression.
2. The turning arm 24 is fixed to fixing point 40 on the shaft 25.
3. Dry air is introduced to the cylinder 21 via the aperture 30, until the shaft is rotated through 90 degrees, putting the spring under compression.
4. The shaft 25 is secured in position by means of a screw (not shown) which is threaded into a screw hole (not shown) on the underside of the base plate 26 and into a screw hole (not shown) on the underside of the shaft 26.
5. The dry air pressure is reduced to zero.
6. The turning arm 24 is disconnected from fixing point 40.
7. The turning arm 24 is pushed back through 90 degrees until the seal 22 is adjacent the lower end element 27.
8. The turning arm 24 is fixed to fixing point 41 on the shaft 25.
9. The shaft 25 is disconnected from the base plate 26.

To disassemble the device for servicing and cleaning the above steps are reversed.

The actuators of this invention have several advantages over the prior art. Firstly, there is no need to transfer a linear motion into a rotary motion. As a result a constant torque can be applied to the valve actuating shaft, which means that an excess of power is not supplied mid stroke to satisfy the break-out torque requirement at the beginning of the stroke. The actuator of this invention provides break-out torque at all points of the stroke.

Secondly, there are very few moving parts, which leads to ease and reduced cost of construction and a lower failure rate. Further, many known valve actuators use a number of cylinders in various arrangements, but in this invention there is only one cylinder which significantly reduces its complexity.

Thirdly, the actuators can be constructed from stainless steel with the necessary finish inside the cylinder, which means the devices can be readily cleaned and sanitised for various applications.

Fourthly, the a flat spiral spring is used which can be attached to the actuator for use and put under compression in safety, and disassembled for cleaning and maintenance in safety.

Fifthly, because the circular base plate has an open area sensitive controls, switches and measuring apparatus can be contained in a protected and secure environment under the cover.

Although a preferred embodiment of the invention has been specifically illustrated and described herein, it is to be understood that minor variations may be made in the apparatus without departing from the spirit and scope of the invention, as defined by the appended claims.

What is claimed is:

1. A fluid operated actuator comprising a cylinder, a piston and linkage means connected to the piston, and the cylinder being formed from a straight piece of stainless steel tubing bent through substantially 90 degrees.

2. The fluid operated actuator as claimed in claim 1 in which the linkage means is curved through substantially 90 degrees.

3. The fluid operated actuator as claimed in claim 2 in which the linkage means is connected at an outer end to a turning arm mounted on a rotatable shaft.

4. The fluid operated actuator as claimed in claim 3 in which the turning arm is mounted under compression means for returning the piston to a bottom of the cylinder at the end of each stroke and rotate the rotatable shaft back to its starting position.

5. The fluid operated actuator as claimed in claim 4 in which the cylinder, the turning arm and the compression means are mounted on a base plate so as to prevent lateral or expansional movement between the parts during the operation of the actuator.

6. The fluid operated actuator as claimed in claim 5 in which the compression means is a flat spiral spring mounted at an outer end to a spring mounting means provided on the base plate and at an inner end to one of the rotatable shaft and a connection between the turning arm and the rotatable shaft.

7. The fluid operated actuator as claimed in claim 1 in which the actuator is a 90 degree valve actuator in which the rotatable shaft actuates a valve.

8. The fluid operated actuator as claimed in claim 1 in which the cylinder is a pneumatic cylinder powered by one of pressurized air and dry air.

9. The fluid operated actuator as claimed in claim 8 in which air is introduced to a bottom of the cylinder through an aperture.

10. The fluid operated actuator as claimed in claim 9 in which the piston is an air-tight seal which moves up the cylinder when the air is introduced, and is returned to the bottom by a spring when the air pressure is reduced.

11. The fluid operated actuator as claimed in claim 10 in which lower and upper end elements are provided at each end of the cylinder, and the upper end element having an aperture through which the linkage means can pass.

12. The fluid operated actuator as claimed in claim 5 in which the base plate is a circular disk.

13. The fluid operated actuator as claimed in claim 12 in which the cylinder is mounted adjacent to an edge of the base plate and the shaft passes substantially through the centre of the base plate.

14. The fluid operated actuator as claimed in claim 13 in which a cover is fitted over a top of the valve actuator and to the edge of the base plate.

15. The fluid operated actuator as claimed in claim 14 in which the cover is constructed from a transparent material.

16. The fluid operated actuator as claimed in claim 11 in which the piston, the linkage means, the turning arm, the shaft, the spring, the base plate, the lower end element and the upper end element are constructed from stainless steel.

17. The fluid operated actuator as claimed in claim 1 in which the stainless steel tubing is provided with an internal finish of 25 micro inches or finer.

18. The fluid operated actuator as claimed in claim 3 in which the rotatable shaft is provided with two turning arm fixing points disposed at substantially 90 degrees to one another, locking means for securing the rotatable shaft in position on a base plate, and the turning arm can be releasably attached to either fixing point.

19. The method of placing under compression a fluid operated actuator as claimed in claim 18, comprising the steps of:

mounting the outer end of the coil spring to the spring mounting means on the base plate and the inner end to spring mounting means on the rotatable shaft with the spring under zero compression, mounting the turning arm to the first mounting point provided on the shaft, applying fluid pressure to the cylinder and rotating the shaft through 90 degrees thereby putting the spring under compression, securing the shaft to the base plate with the locking means, releasing the fluid pressure inside the cylinder, disconnecting the turning arm from the shaft, pushing the turning arm, the linkage rod and the piston back through 90 degrees, reconnecting the turning arm to the second mounting point provided on the shaft which is at substantially 90 degrees to the first mounting point, and releasing the shaft from the locking means.

20. A method of placing under compression a fluid operated actuator which includes a cylinder, a piston, a linkage rod, a turning arm, a flat spiral spring and a rotatable shaft, the cylinder is curved through substantially degrees, the linkage rod is connected at an inner end to the piston, the linkage rod is connected at an outer end to the turning arm, the linkage rod is held under compression in use by the flat spiral spring, the shaft is provided with two turning arm fixing points disposed at substantially 90 degrees to one another, the shaft is provided with locking means for securing it in a rotational position, and the turning arm can be realeasably attached to either fixing point comprising the steps of:

mounting the flat spiral spring to the shaft absent compression, mounting the turning arm to a first turning arm fixing point, applying pressure to the cylinder to turn the shaft though substantially 90 degrees, securing the shaft in its rotational position with the locking means, releasing the pressure in the cylinder, disconnecting the turning arm from the first turning arm fixing point, pushing the turning arm, the linkage rod and the piston back through 90 degrees, connecting the turning arm to a second turning arm fixing point, and releasing the shaft from the locking means.

21. The fluid operated actuator as defined in claim 1 including a flat spiral spring for holding the linkage rod under compression.

22. A fluid operated actuator comprising a cylinder, a piston, a linkage rod, a turning arm and a rotatable shaft; the cylinder being curved through a number of degrees, the linkage rod being connected at an inner end to the piston, the linkage rod being connected at an outer end to the turning arm, the shaft being provided with two turning arm fixing points disposed at substantially 90 degrees to one another, the shaft having locking means for securing the shaft in a selected rotational position, and the turning arm can be releasably attached to either fixing point.

* * * * *